United States Patent [19]

Slattery et al.

[11] Patent Number: 4,892,197

[45] Date of Patent: Jan. 9, 1990

[54] GOLF BALL DISPLAY STAND

[76] Inventors: Carroll A. Slattery, 882 Harness Trail; Carlos Z. Rodriguez, 10144 Colebrook Ave., both of Potomac, Md. 20854

[21] Appl. No.: 324,089

[22] Filed: Mar. 16, 1989

[51] Int. Cl.[4] ..... A47G 19/28

[52] U.S. Cl. ..... 211/14; 211/129; 211/163; 211/194

[58] Field of Search ..... 211/14, 77, 133, 163, 211/194, 128, 129, 15; D6/455, 466–469, 552, 526, 534

[56] References Cited

U.S. PATENT DOCUMENTS

| | | | |
|---|---|---|---|
| D. 220,592 | 4/1971 | Howard . | |
| D. 257,923 | 1/1981 | Wolfe, Sr. | D6/552 |
| 663,838 | 12/1900 | White . | |
| 697,247 | 4/1902 | Harris . | |
| 1,577,962 | 3/1926 | Gatchell | 211/163 X |
| 1,585,959 | 5/1926 | Avery | 211/13 |
| 1,595,449 | 8/1926 | Carrm | 211/14 X |
| 1,648,528 | 11/1927 | Ziringer | 211/163 X |
| 1,810,258 | 6/1931 | Sperber . | |
| 1,998,490 | 4/1935 | Carmm . | |
| 2,028,026 | 1/1936 | Storch | 211/13 |
| 2,102,982 | 12/1937 | Taylor | 211/77 X |
| 2,281,849 | 5/1942 | McCoppin . | |
| 2,318,081 | 5/1943 | Kerry | 211/13 |
| 2,534,680 | 12/1950 | Poirier et al. | 211/77 X |
| 2,756,901 | 7/1956 | Cowsert | 211/14 X |
| 3,169,496 | 2/1965 | Muggli et al. . | |
| 3,198,338 | 8/1965 | McCormick | 211/14 |
| 3,331,515 | 7/1967 | Lange | 211/77 |
| 3,677,414 | 7/1972 | Rock | 211/13 |
| 4,011,954 | 3/1977 | Galli | 211/14 |
| 4,561,547 | 12/1985 | Estwanik | 211/13 |

FOREIGN PATENT DOCUMENTS

| | | |
|---|---|---|
| 991041 | 6/1951 | France . |

*Primary Examiner*—Reinaldo P. Machado
*Attorney, Agent, or Firm*—Shlesinger & Myers

[57] ABSTRACT

A display stand for displaying spherical articles, which when displayed with golf balls has the appearance of a spheroid with dimples thereon. The upper section of the stand includes generally circular support plates of varying diameters arranged in a stacked fashion one atop the other, and separated by centrally positioned generally tee-shaped spacing elements. The plates include generally C-shaped cut-out recesses cut into the peripheral edge thereof for receiving and holding golf balls therein. A light bulb may be positioned atop the top most spacing element or, alternatively, a fluorescent light tube may be positioned within the central support shaft, for lighting the display stand.

15 Claims, 3 Drawing Sheets

GOLF BALL DISPLAY STAND

HISTORICAL BACKGROUND AND FIELD OF THE INVENTION

The present invention is directed to a display stand for displaying various articles, and more particularly to displaying golf balls and the like.

Various types of display devices are disclosed in U.S. Pat. Nos. 663,838; 697,247; 1,810,258; 2,281,849; 3,169,496; 3,198,338; 4,011,954; Design 220,592; and French 991,041. However, none of these patents show a display stand which is directed to displaying golf balls, and which when assembled and displayed with golf balls thereon, has the appearance of a spheroid with dimples thereon. In view of the above, there is a need in the art for a stand or device which may be used for displaying golf balls and which has an aesthetic appearance.

OBJECTS AND SUMMARY OF THE INVENTION

The principal object of the present invention is to provide a display stand for displaying spherical articles which when displayed with the golf balls or the like has the appearance of a spheroid with dimples thereon.

It is another object of the present invention to provide a display stand in which several golf balls are peripherally arranged, and therefore each ball is visible.

It is yet another object of the present invention to provide a display stand which is light-weight and relatively inexpensive to manufacture.

An additional object of the present invention is to provide a display stand which is very compact in disassembled position, and therefore easy to ship.

It is yet an additional object of the present invention to provide a display stand which is easy to assemble.

Still an additional object of the present invention is to provide a display stand which is very attractive in appearance.

In summary, the main object of the present invention is to provide a display stand for displaying spherical articles, which when displayed with golf balls or the like, imparts the appearance of a spheroid with dimples thereon.

BRIEF DESCRIPTION OF THE DRAWINGS

The above and other objects and advantages and novel features of the present invention will become apparent from the following detailed description of the preferred embodiment of the invention illustrated in the accompanying drawings, in which:

FIG. 2 is an enlarged top plan view of FIG. 1 showing in phantom lines additional cut-out recesses for receiving and supporting additional golf balls or the like;

DETAILED DESCRIPTION OF THE INVENTION

Figure 1:
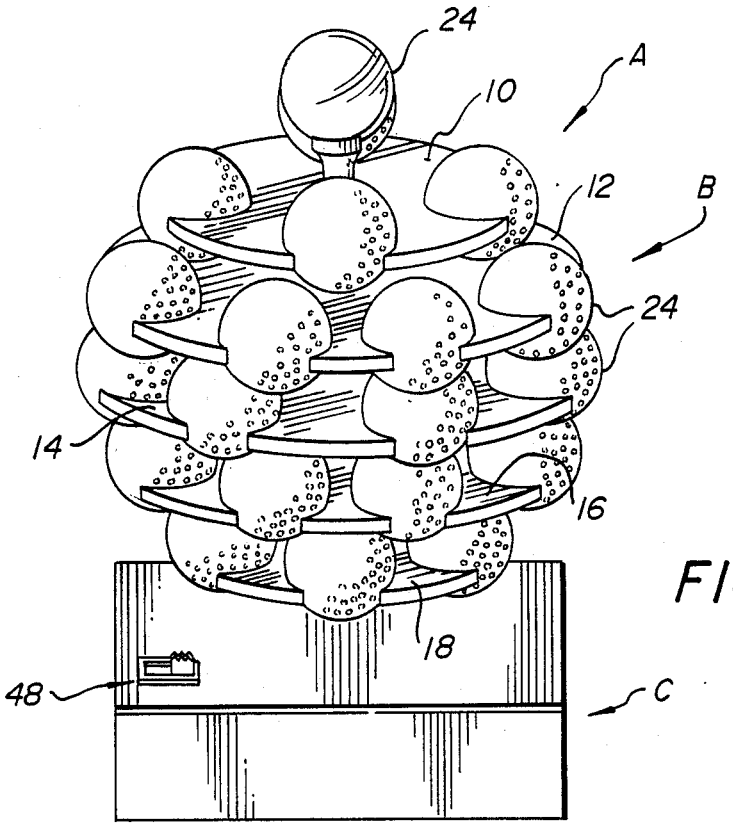
FIG. 1 is a perspective view of the display stand of the present invention with the golf balls received in the cut-out recesses.

The display stand made in accordance with the present invention generally indicated in FIG. 1 as A, includes a generally spherical upper section B supported on base section C. As best seen in FIG. 1, upper section B has the appearance of a spheroid with dimples thereon.

Figure 3:
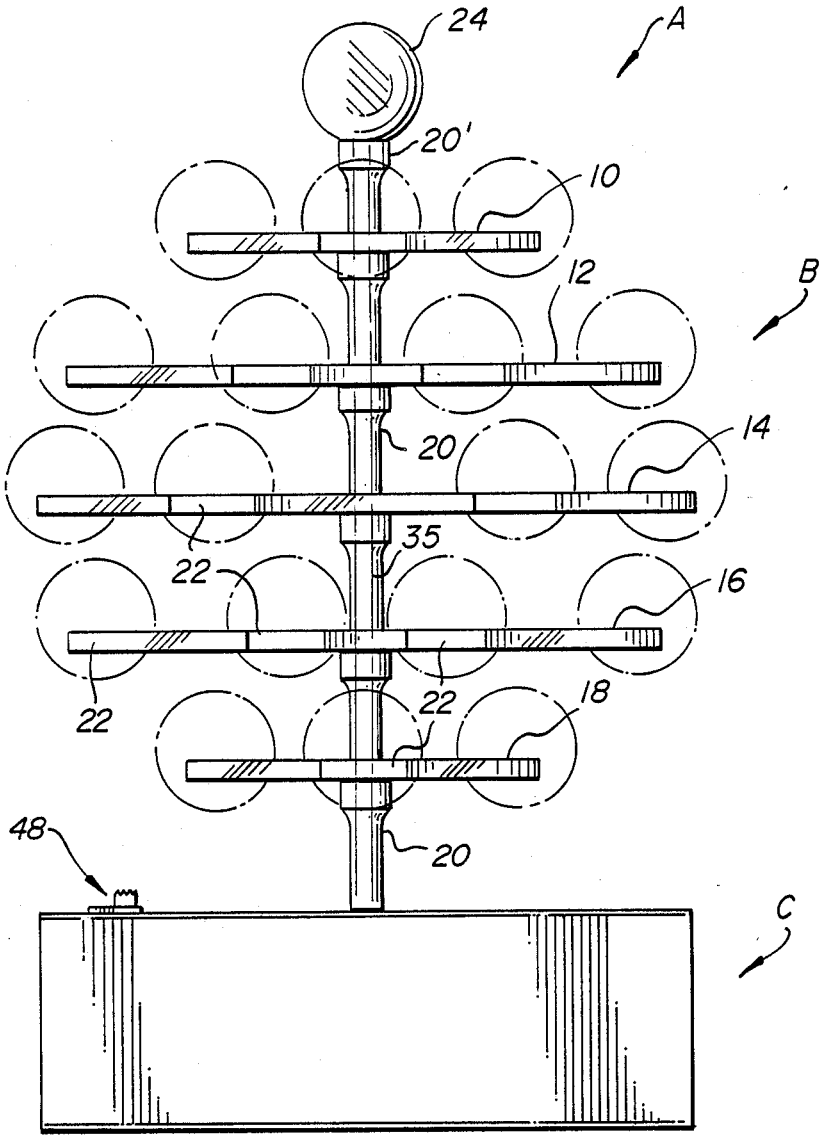
FIG. 3 is an enlarged front elevational view of FIG. 1, showing the golf balls in phantom lines.

As more clearly shown in FIG. 3, upper section B is made from a number of support plates 10, 12, 14, 16 and 18, which are arranged in a stacked fashion. The plates 10, 12, 14, 16 and 18 are generally circular in shape and are of different diameters. More particularly, the centrally positioned support plate 14 has the largest diameter of all the plates, and support plates 12 and 16 have a diameter less than the diameter of plate 14. The top most plate 10 and the bottom most plate 18 have the least diameter of all support plates. In other words, the support plates 10, 12, 14, 16 and 18, are arranged so that their diameters decrease from the center of upper section B towards top and bottom thereof. In between support plates 10, 12, 14, 16 and 18, are vertically positioned generally tee-shaped spacing elements 20, the length of which are slightly less than the diameter of the golf balls. It should be noted that although only five (5) support plates and six (6) spacing elements 20, are shown herein, it is well within the scope of this invention to vary the number thereof, in order to obtain display stands of varying sizes.

Figure 2:
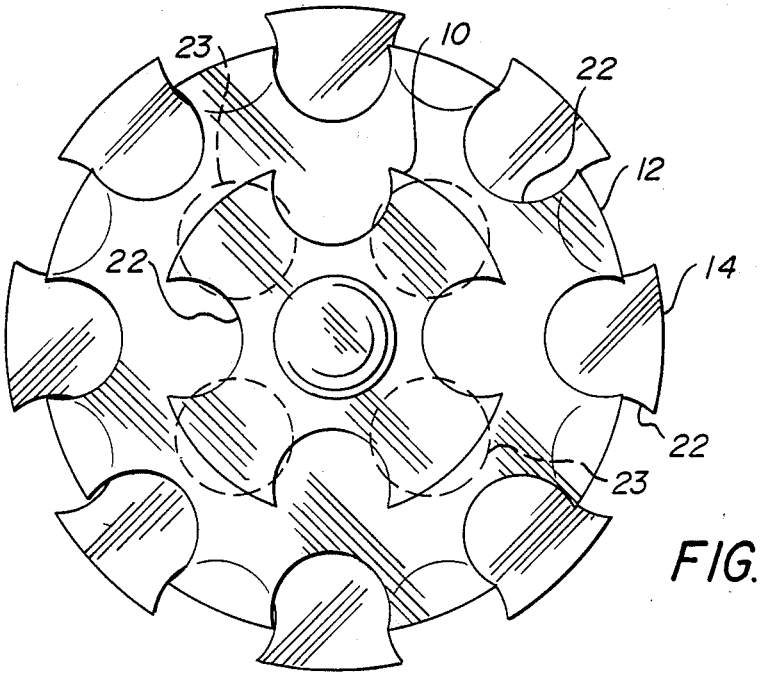

As best seen in FIG. 2, support plates 10, 12, 14, 16 and 18, each includes generally C-shaped cut-out recesses 22 disposed equidistant around the peripheral edge thereof. Cut-out recesses 22 have a diameter which is less than the diameter of a golf ball, such that when golf balls 24 are placed therein, they are securely held in corresponding cut-out recesses 22. As shown by phantom lines in FIG. 2, support plate 14 may have additional cut-out recesses 23 that are staggered with recesses 22.

Figure 4:
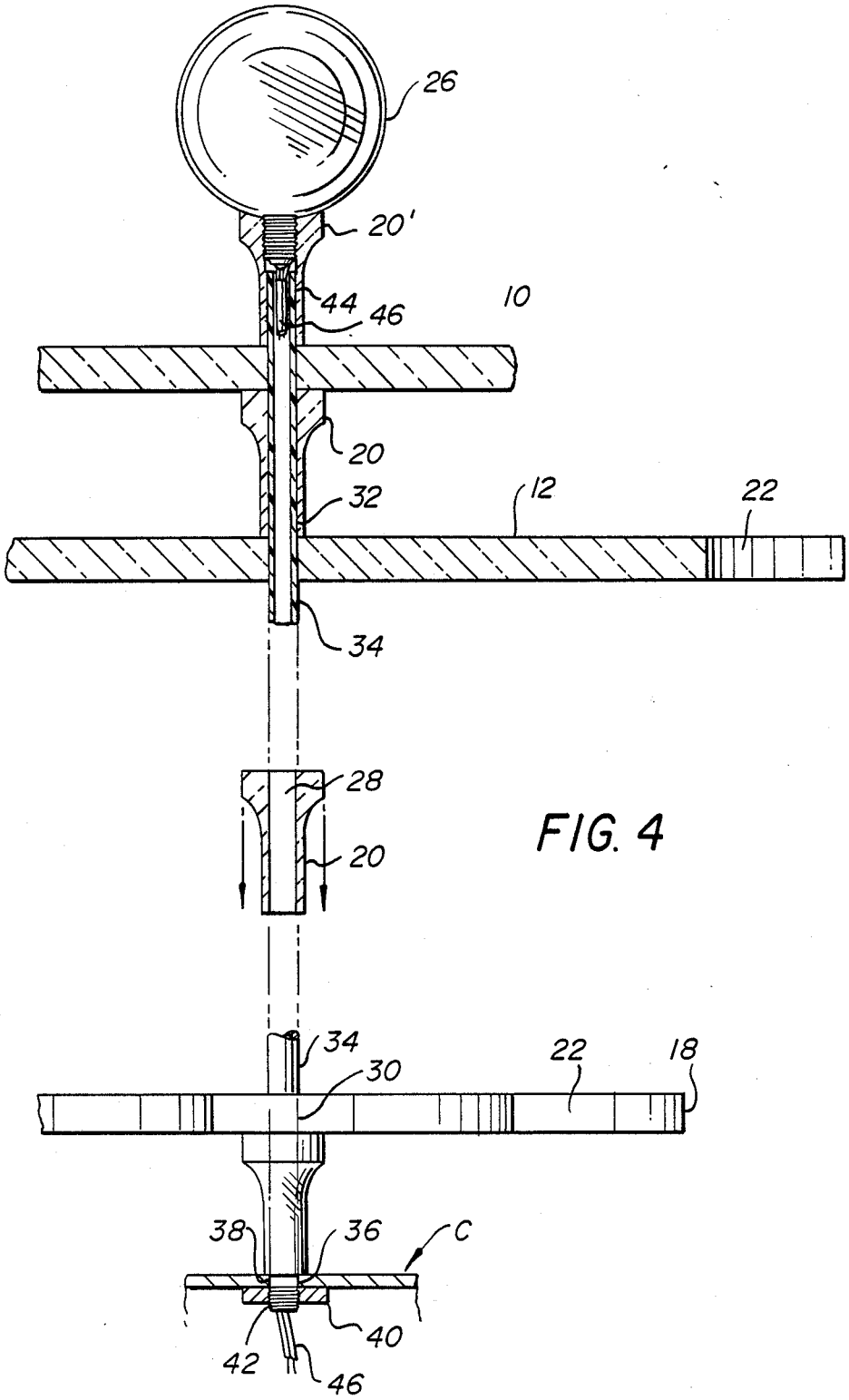
FIG. 4 is a partial, enlarged sectional view of an alternate embodiment and showing the details of interfittings of various members.

A light-bulb 26 or a golf ball 24 may be positioned atop the top most spacing element 20' for lighting display stand A. As shown in FIG. 4, each spacing element 20 includes a vertically extending central sleeve 28. Similarly, each of support plates 10, 12, 14, 16 and 18 also includes a centrally located hole 30 such that when display stand A is assembled, shown in FIG. 1, sleeve 28 and holes 30 are aligned to provide a vertically extending continuous channel 32 for receiving a generally hollow support shaft 34 therein .

The lower end 36 of hollow support shaft 34 is received in a hole 38 in base section C, and is secured therein by a conventional nut 40 fastened to screw-threads 42 provided on lower end 36. The upper end 44 of support shaft 34 is received in sleeve 28 of the top most spacing element 20'. As shown in FIG. 3, a golf ball 24 is positioned atop the top most spacing element 20', and a fluorescent light emitting tube 35 or the like is positioned within hollow shaft 34. Alternatively, as shown in FIG. 4, a light bulb 26 may be placed atop the top most spacing element 20' and an electrical wire connection 46 or the like may be provided within support shaft 34, which makes a connection between light-bulb 26 and a switch 48 located on base section C. A battery or the like (not shown) may be provided in a convenient location within base section C for connection with light-bulb 26 and switch 48.

It should be noted that the support plates 10, 12, 14, 16 and 18, and spacing elements 20, may be made of a light-weight material, such as plastic or cardboard. The plastic material may be transparent, translucent, or opaque, and may be colored for aesthetics. Similarly, base section C may also be made from a suitable light-weight material, such as plastic, light-wood or cardboard.

As can be seen from the above, the display stand A of the present invention may be easily assembled by placing spacing elements 20 in between support plates 10, 12, 14, 16 and 18, after securely fastening support shaft 34 in base section C. Once assembled, display stand A may be used to display golf balls 24, which imparts the appearance of a spheroid with dimples thereon. The display stand A of the present invention can also be easily disassembled and shipped in compact containers.

While this invention has been described as having a preferred design, it is understood that it is capable of further modifications, uses and/or adaptations of the invention and following in general the principle of the invention and including such departures from the present disclosure as have come within the known or customary practice in the art to which the invention pertains, and as may be applied to the central features hereinbefore set forth, and fall within the scope of the invention or limits of the claims appended hereto.

WHAT IS CLAIMED IS:

1. A display device for displaying golf balls or the like, comprising:

(a) an upper section including a plurality of supporting means arranged in a stacked fashion;

(b) a base section supporting said upper section and including an upper surface;

(c) a plurality of spacer means interposed between said supporting means and including top and bottom spacer means, said top spacer means including means for displaying a golf ball and said bottom spacer means being disposed above said upper surface of said base section;

(d) each said supporting means being generally flat and circular and including a peripheral edge;

(e) a series of similar C-shaped cut-out recesses cut into said peripheral edge so that the open portion of said C-shape faces outwardly of said peripheral edge and for receiving and supporting a spherical article of a diameter greater than the diameter of said C-shaped cut-out recesses such that said spherical article when supported in said C-shaped recess has a substantial portion extending beyond said peripheral edge;

(f) said spacer means being of a length slightly less than the diameter of the spherical articles to be supported on the display device;

(g) said C-shaped cut-out recesses being of similar dimension and spaced equidistant around said peripheral edge;

(h) said C-shaped cut-out recesses being generally circular in configuration; and (i) said upper section being generally spherical in shape so that when displayed with the spherical articles the display device with the spherical articles thereon will have the appearance of a spheroid with dimples thereon.

2. The display device of claim 1, wherein:

(a) said spacer means are generally tee shaped.

3. The display device of claim 1, wherein:

(a) said supporting means comprises generally circular plates made of a plastic material.

4. The display device of claim 3, wherein:

(a) said plates are of different diameters.

5. The display device of claim 3, wherein:

(a) said spacer means each includes a generally vertically extending sleeve disposed about the center thereof;

(b) said plates each including a hole about the center thereof; and (c) a support shaft extending vertically through said sleeves and said holes so that one end thereof is removably fastened to said base section and another end thereof is free and extends beyond an uppermost plate.

6. The display device of claim 5, wherein:

(a) one said spacer means is positioned on said uppermost plate;

(b) lighting means positioned atop said one of said spacer means; and (c) a switch positioned on the display device.

7. The display device of claim 6, wherein:

(a) said support shaft is generally hollow for running an electric wire therein for connecting said lighting means with said switch.

8. The display device of claim 1, wherein:

(a) said supporting means and said spacer means are made of a plastic material.

9. A display device for displaying golf balls or the like, comprising:

(a) an upper section including a plurality of supporting means arranged in a stacked fashion;

(b) a base section supporting said upper section and including an upper surface;

(c) a plurality of spacer means interposed between said supporting means and including top and bottom spacer means, said top spacer means including means for displaying a golf ball and said bottom spacer means being disposed above said upper surface of said base section;

(d) each said supporting means being generally flat and circular and including a peripheral edge;

(e) a series of similar C-shaped cut-out recesses cut into said peripheral edge so that the open portion of said C-shape faces outwardly of said peripheral edge;

(f) a plurality of spherical articles of a diameter greater than the diameter of said C-shaped cut-out recesses received therein such that said spherical articles have substantial portion extending beyond said peripheral edge;

(g) said spacer means being of length slightly less than the diameter of said spherical articles;

(h) said C-shaped cut-out recesses being of similar dimension and spaced equidistant around said peripheral edge;

(i) said C-shaped cut-out recesses being generally circular in configuration; and (j) said upper section being generally spherical in shape so that the display device with said spherical articles thereon has the appearance of a spheroid with dimples.

10. The display device of claim 9, wherein:

(a) said spacer means are generally tee shaped.

11. The display device of claim 9, wherein:

(a) said spherical articles are golf-balls.

12. The display device of claim 9, further comprising:

(a) means for lighting up the display device.

13. The display device of claim 12, wherein:

(a) said spacer means each including a generally vertically extending sleeve disposed about the center thereof;

(b) said supporting means each including a hole about the center thereof; and (c) a generally hollow support shaft extending vertically through said sleeves and said holes so that one end thereof is removably fastened to said base section and another end thereof is free and extends beyond an uppermost supporting means.

14. The display device of claim 13, wherein:

(a) said lighting means including a light emitting tube positioned within said support shaft.

15. The display device of claim 14, wherein:

(a) said light emitting tube is a fluorescent light tube.

* * * * *